US009073171B2

(12) United States Patent
Kim et al.

(10) Patent No.: US 9,073,171 B2
(45) Date of Patent: Jul. 7, 2015

(54) POLISHER, PRESSURE PLATE OF THE POLISHER AND METHOD OF POLISHING

(75) Inventors: Hong Gil Kim, Seoul (KR); Pan Gi Min, Icheon-si (KR)

(73) Assignee: LG SILTRON INC., Gumi, Gyeonsangbuk-Do (KR)

( * ) Notice: Subject to any disclaimer, the term of this patent is extended or adjusted under 35 U.S.C. 154(b) by 806 days.

(21) Appl. No.: 13/124,875

(22) PCT Filed: Oct. 21, 2009

(86) PCT No.: PCT/KR2009/006074

§ 371 (c)(1), (2), (4) Date: Jun. 3, 2011

(87) PCT Pub. No.: WO2010/047520

PCT Pub. Date: Apr. 29, 2010

(65) Prior Publication Data

US 2011/0230123 A1 Sep. 22, 2011

(30) Foreign Application Priority Data

Oct. 21, 2008 (KR) ..... 10-2008-0103161

(51) Int. Cl.
*B24B 49/00* (2012.01)
*B24B 37/04* (2012.01)
*B24B 41/00* (2006.01)

(52) U.S. Cl.
CPC ..... *B24B 37/042* (2013.01); *B24B 41/002* (2013.01)

(58) Field of Classification Search
CPC ..... B24B 37/27; B24B 37/30; B24B 37/32
USPC ..... 451/41, 285–290, 388, 390, 398
See application file for complete search history.

(56) References Cited

U.S. PATENT DOCUMENTS

| | | | | |
|---|---|---|---|---|
| 3,571,978 | A * | 3/1971 | Day et al. | 451/288 |
| 3,888,053 | A | 6/1975 | White et al. | |
| 3,977,130 | A * | 8/1976 | Degner | 451/288 |
| 4,918,869 | A | 4/1990 | Kitta | |
| 5,635,083 | A | 6/1997 | Breivogel et al. | |
| 5,931,725 | A * | 8/1999 | Inaba et al. | 451/288 |
| 6,012,964 | A | 1/2000 | Arai et al. | |
| 6,102,779 | A | 8/2000 | Cesna et al. | |
| 6,110,026 | A | 8/2000 | Arai | 451/289 |
| 6,383,059 | B1 * | 5/2002 | Gotcher | 451/41 |
| 6,494,774 | B1 * | 12/2002 | Zuniga et al. | 451/398 |
| 6,726,529 | B2 * | 4/2004 | Marcyk et al. | 451/7 |
| 7,156,720 | B2 * | 1/2007 | Saito et al. | 451/11 |
| 7,311,586 | B2 * | 12/2007 | Maloney et al. | 451/41 |
| 7,488,240 | B2 * | 2/2009 | Saito | 451/285 |
| 7,662,025 | B2 * | 2/2010 | Saito | 451/11 |
| 2004/0002291 | A1 | 1/2004 | Renteln | |
| 2004/0185755 | A1 | 9/2004 | VanHanehem | |
| 2006/0199479 | A1 * | 9/2006 | Togawa et al. | 451/59 |
| 2006/0270323 | A1 * | 11/2006 | Togawa | 451/8 |
| 2007/0270089 | A1 * | 11/2007 | Saito | 451/285 |
| 2008/0166957 | A1 * | 7/2008 | Togawa et al. | 451/288 |
| 2008/0254720 | A1 * | 10/2008 | Hashimoto et al. | 451/288 |

FOREIGN PATENT DOCUMENTS

| | | | |
|---|---|---|---|
| CN | 2712547 | Y | 7/2005 |
| CN | 101028699 | A | 9/2007 |
| JP | H09-174417 | A | 7/1997 |
| JP | H11-42556 | A | 2/1999 |
| JP | 2001-341062 | A | 12/2001 |
| JP | 2003-086549 | A | 3/2003 |
| JP | 2004-148457 | A | 5/2004 |
| JP | 2004-358590 | A | 12/2004 |
| JP | 2003-151931 | A | 5/2005 |
| JP | 2003-151934 | A | 5/2005 |
| JP | 2005-531930 | A | 10/2005 |
| KR | 10-2004-0011433 | A | 2/2004 |
| KR | 10-2006-0016938 | A | 2/2006 |
| KR | 10-0814069 | B1 | 3/2008 |
| WO | WO 03/020471 | A1 | 3/2003 |

OTHER PUBLICATIONS

PCT International Search Report and Written Opinion dated Feb. 19, 2010 issued in Application No. PCT/KR2009/006074.
Korean Office Action dated Nov. 12, 2010 issued in Application No. 10-2008-0103161.
International Search Report issued in PCT Application No. PCT/KR2009/006074 dated Feb. 19, 2010.
Japanese Office Action dated Nov. 7, 2013 issued in Application No. 2011-532026.
Chinese Office Action dated Jan. 15, 2013 issued in Application No. 200980142405.6 (with English translation).
Japanese Office Action dated Apr. 8, 2014 issued in Application No. 2011-532026.
European Search Report issued in Application No. 09822196.3 dated Mar. 10, 2015.

* cited by examiner

*Primary Examiner* — Maurina Rachuba
(74) *Attorney, Agent, or Firm* — Ked & Associates, LLP

(57) ABSTRACT

A polisher, a pressure plate (20) of the polisher, and a method of polishing are disclosed. The pressure plate (20) includes a main body, an air bag (50) mounted to one surface of the main body to adjust a pressure applied from the main body to a polishing object, and a pad (**16*b***) having a ring shape, mounted along a circumference of the one surface of the main body.

11 Claims, 4 Drawing Sheets

POLISHER, PRESSURE PLATE OF THE POLISHER AND METHOD OF POLISHING

TECHNICAL FIELD

The present invention relates to a polisher, a pressure plate of the polisher and a method of polishing, and more particularly to a polisher equipped with a pressure plate, the polisher capable of applying a uniform pressure through a wafer mounting block, minimizing the frequency of replacement of a ring pad, maintaining a uniform polishing rate of a wafer, improving flatness of the wafer, and facilitating manufacturing and connection and separation of an air bag, and a method of polishing using the polisher.

BACKGROUND ART

Polishing is one of the processes for manufacturing a wafer, performed by polishing a wafer so as to reduce a thickness thereof by about 10 μm to remove damaged portions generated in a previous process and adjusting localized light scatter (LLS) and haze while minor-surface polishing a surface of the wafer.

FIG. 1 illustrates a perspective view showing a polisher according to a conventional art. Hereinafter, the polisher will be described with reference to FIG. 1.

As shown in FIG. 1, the conventional polisher includes a plate 12, a mounting block 14, a pressure plate 16, a center guide 17 and an outer guide 18.

An abrasive cloth 11 is attached to an upper surface of the plate 12, and the plate 12 is rotated at a predetermined rpm. The mounting block 14, upon which a wafer is mounted, is mounted on the plate 12. The pressure plate 16 is capable of rotating while applying a predetermined pressure to the mounting block 14. The center guide 17 and the outer guide 18 guide the mounting block 14 to be positioned right under the pressure plate 16.

When the pressure plate 16 rotates in the state of pressing the mounting block 14, polishing is performed through the interaction between the abrasive cloth 11 and a polishing solution. Since such structures are generally known and employed in the polisher 10, a detailed description thereof will be omitted.

As described above, the pressure plate 16 applies a predetermined pressure to the mounting block 14 while rotating, thereby generating friction between the wafer and the abrasive cloth 11. Polishing of the wafer is thus achieved as the friction mirror-surface polishes a surface of the wafer. Here, a central shaft 16*a* of the pressure plate 16 is connected to a cylinder (not shown) which adjusts the pressure of the pressure plate 16 applied to the mounting block 14.

However, the above polisher according to a conventional art has some problems as follows. FIG. 2 illustrates a view showing the pressure applied to the mounting block in which the pressure plate is mounted with the wafer in the polisher shown in FIG. 1.

In FIG. 2, arrow marks denote the degree of pressure applied by the pressure plate 16 to the mounting block 14. As shown in FIG. 2, when the pressure plate 16 applies a pressure to the mounting block 14, the pressure is greater at the center of the mounting block 14 than at the periphery of the mounting block.

To avoid such non-uniformity of the pressure, a ring pad is conventionally attached to a lower surface of the pressure plate.

FIG. 3 illustrates the pressure of a pressure plate mounted with a ring pad, applied to the mounting block. FIG. 4 illustrates an enlarged view of a portion A of FIG. 3. FIG. 5 illustrates a bottom view of the pressure plate shown in FIG. 3.

The pressure plate 19 shown in FIG. 3 to FIG. 5 is mounted with a pad 16*b* having a ring shape, mounted along the circumference of a lower surface thereof, so as to apply a relatively uniform pressure to the mounting block 14.

However, when using the pressure plate 19, the ring pad 16*b* needs to be newly manufactured for each case to have different diameters according to conditions of each case to maintain flatness of the wafer. Furthermore, if the center of the pressure plate 19 is not accurately corresponded to the center of the ring pad 16*b*, flatness of the wafer may be deteriorated. Also, an abrasive cloth is necessary to manufacture the ring pad 16*b*.

Otherwise, the pressure of the cylinder (not shown) applied to the pressure plate 19 may be adjusted instead of changing the diameter of the ring pad 16*b*. In this case, however, polishing may not be uniformly performed due to variation of the pressure, accordingly causing damage to the wafer surface. That is, inferior goods may be produced.

DISCLOSURE OF INVENTION

Technical Problem

An object of the present invention devised to solve the problem lies in a pressure plate of a polisher, capable of applying a uniform pressure to a mounting block mounted with a wafer.

Another object of the present invention devised to solve the problem lies in a pressure plate capable of improving flatness of a wafer.

A further object of the present invention devised to solve the problem lies in a pressure plate capable of minimizing the necessity of replacing a ring pad attached thereto.

A still further object of the present invention devised to solve the problem lies in a pressure plate capable of maintaining a uniform pressure of a cylinder applied to a pressure plate, thereby maintaining a uniform polishing rate of a wafer.

Technical Solution

The object of the present invention can be achieved by providing a pressure plate of a polisher, including a main body, an air bag mounted to one surface of the main body to adjust a pressure applied from the main body to a polishing object, and a pad having a ring shape, mounted along a circumference of the one surface of the main body.

In another aspect of the present invention, provided herein is method of polishing a wafer, including attaching a mounting block to which a wafer is bonded, to a pressure plate, a main body of which is mounted with an air bag on one surface thereof and a ring pad on a circumference of the one surface, mounting a plurality of the pressure plate mounted with the mounting block, in close contact with a plate of a polisher, and supplying a polishing solution to between the plate and the wafer, and polishing one surface of the wafer while adjusting a pressure applied to the mounting block by properly supplying a fluid into the air bag.

In a further aspect of the present invention, provided herein is a polisher including a plate supplied with an abrasive cloth and a polishing solution, at least one pressure plate, a main body of which is provided with an air bag on one surface thereof and a ring-shape pad on a circumference of the one surface, and a mounting block, a first face of which is attached with the pressure plate and a second face of which is bonded with a wafer.

Advantageous Effects

As described above, a polisher, a pressure plate of the polisher, and a method of polishing using the polisher according to the embodiment of the present invention have several effects as described in the following.

First, a pressure can be applied uniformly throughout a mounting block mounting a wafer thereon, accordingly improving flatness of the wafer.

Second, the pressure applied to the mounting block can be adjusted using an air bag. Therefore, frequency of replacement of a ring pad may be minimized. Also, a downtime of the polisher, during which the polisher cannot be operated for replacement of the ring pad, can be reduced. In addition, use of an abrasive cloth used for manufacturing a new ring pad may be reduced.

Third, since the pressure applied to the mounting block is adjusted using the air bag while maintaining a constant pressure of a cylinder, a polishing rate of the wafer can be uniformly maintained.

Fourth, connection and separation of the air bag are facilitated.

Fifth, the air bag may be manufactured with ease and at a low cost since it has a rubber plate form rather than a tube form.

BRIEF DESCRIPTION OF DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings. The same structures and elements explained in the conventional art will be denoted by the same reference symbols as in the conventional art, and a detailed description thereof will be omitted.

Figure 1:
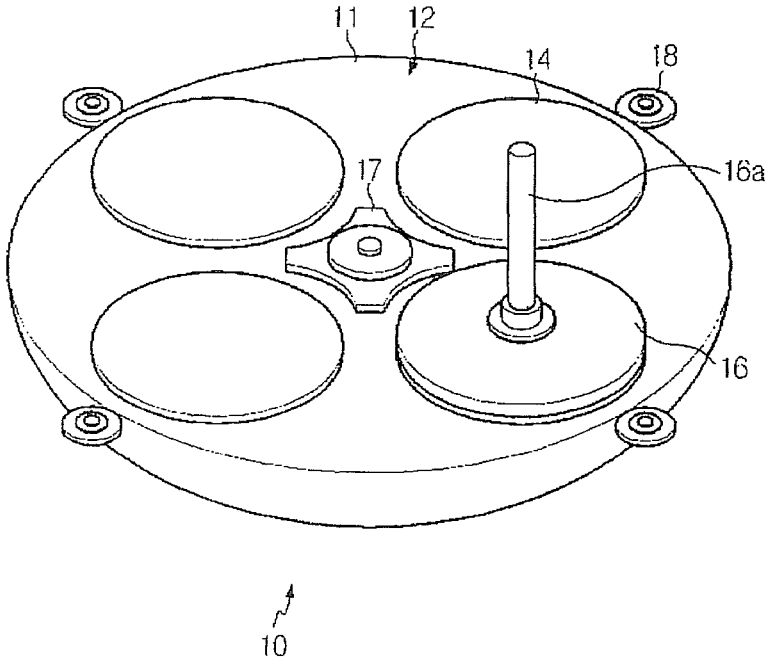
Fig. 1 PRIOR ART
FIG. 1 illustrates a perspective view of a polisher according to the conventional art.
Figure 2:
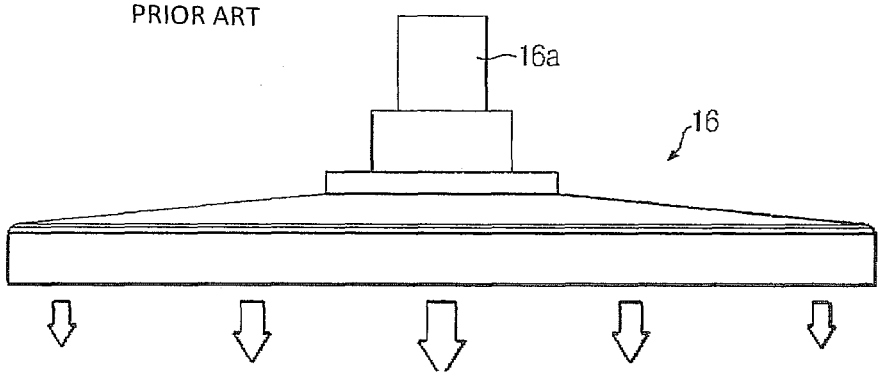
Fig. 2 PRIOR ART
FIG. 2 illustrates a pressure applied by a pressure plate to a mounting block mounted with a wafer in the polisher shown in FIG. 1.
Figure 3:
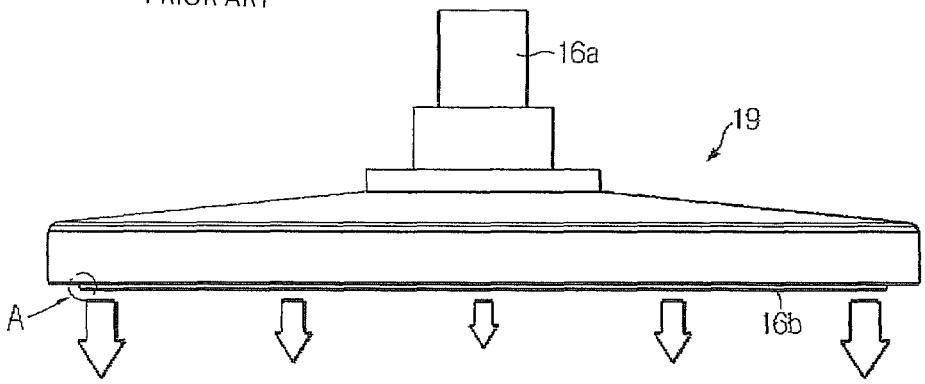
Fig. 3 PRIOR ART
FIG. 3 illustrates a pressure applied to the mounting block by a pressure plate to which a ring pad is attached.
Figure 4:
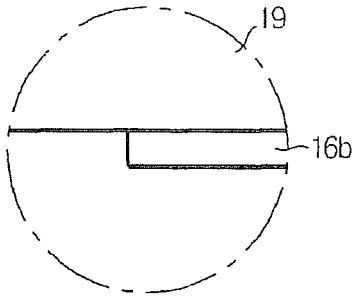
Fig. 4 PRIOR ART
FIG. 4 illustrates an enlarged view of a portion A of FIG. 3.
Figure 5:
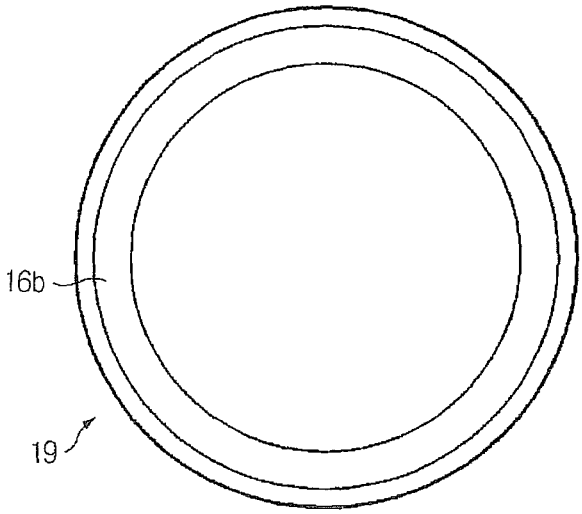
Fig. 5 PRIOR ART
FIG. 5 illustrates a bottom view of the pressure plate shown in FIG. 3.
Figure 6:
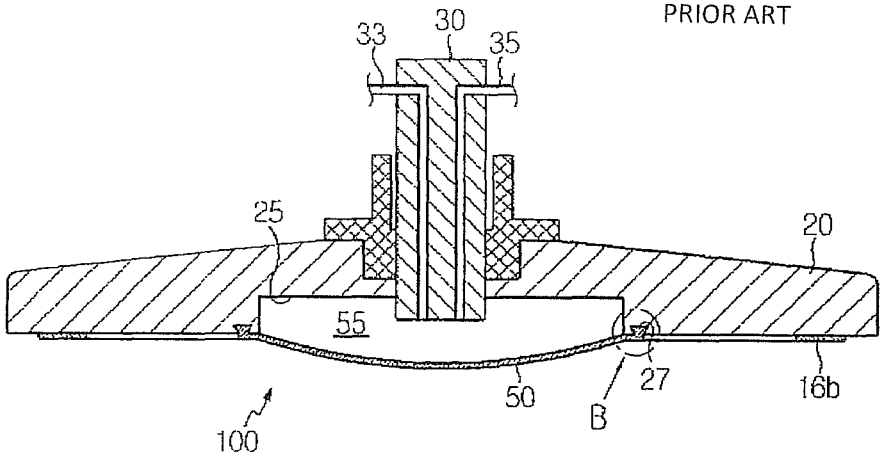
Fig. 6 PRIOR ART
FIG. 6 illustrates a view of a pressure plate of a polisher according to an embodiment of the present invention.

FIG. 6 illustrates a pressure plate of a polisher according to an embodiment of the present invention. The pressure plate of the polisher will be explained with reference to FIG. 6.

As shown in FIG. 6, the pressure plate 100 includes a main body 20, a central shaft 30 of the main body 20, an air bag 50 disposed in the center of a lower surface of the main body 20, and a ring pad **16*b* having an annular form arranged along the circumference of a lower surface of the main body 20**.

In FIG. 6, the same reference numerals as in the description of FIG. 1 to FIG. 5 are used to indicate the same structures and elements shown in FIG. 1 to FIG. 5.

The ring pad **16*b* is provided to apply a uniform pressure to the mounting block to which a polishing object, that is, a wafer is mounted during the polishing process that will be described later. The ring pad 16*b* has a diameter appropriate for maintaining a flatness of the wafer to be polished. The ring pad 16*b* may be polished by an abrasive cloth. Here, it is exemplary that the center of the pressure plate 100 is corresponded to the center of the ring pad 16*b***.

Additionally, the main body 20 has a circular form, an upper surface of which is connected to the central shaft 30. The main body 20 may press the mounting block 14 to which the wafer is mounted.

Figure 7:
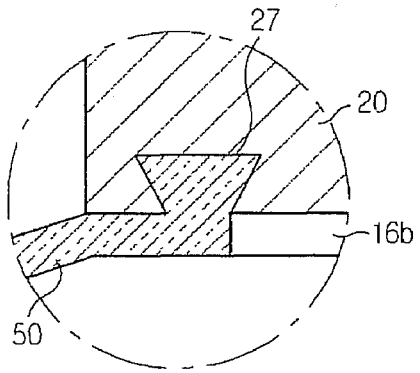
Fig. 7 PRIOR ART
FIG. 7 illustrates an enlarged view of a portion B of FIG. 6.

FIG. 7 is an enlarged view of a portion B shown in FIG. 6. Hereinafter, the connection structure between the main body 20 of the pressure plate 100 and the air bag 50 in the polisher will be described with reference to FIG. 6 and FIG. 7.

As shown in the drawings, a depression 25 having a predetermined depth and diameter is formed in the center of the lower surface of the main body 20. A groove 27 is formed around the depression 25 so that a circumference of the air bag 50 is fixedly inserted in the groove 27.

In addition, the central shaft 30 of the pressure plate 100 is connected to an upper surface of the main body 20. The central shaft 30 may be rotated by a rotational force of a driving motor (not shown) to thereby rotate the main body 20. A cylinder (not shown) is connected to the central shaft 30 to adjust the pressure applied by the main body 20 to the mounting block 14.

The air bag 50 has a flat plate form and is mounted to cover the depression 25, thereby forming an air chamber 55. The circumference of the air bag 50 is inserted and fixed in the groove 27. Exemplarily, the air bag 50 may be formed of an elastic material such as rubber so as to be expanded and contracted as will be described later.

The air bag 50 having the flat plate form is more efficient in manufacturing than a tube-form air bag to receive a compressed air. Also, the air chamber 55 can be formed by preparing the depression 25 at the lower surface of the main body 20 and covering the depression 25 with the air bag 50. Thus, installation of the air bag 50 can be achieved conveniently. Furthermore, since the air bag 50 is installed at the outside of the main body 20, the pressure plate 100 does not have to be separated when the air bag 50 is installed or replaced. That is, installation and replacement of the air bag 50 can be performed conveniently.

As described above, the air bag 50 and the depression 25 form the air chamber 55, and the air chamber 55 is connected with an inlet pipe 33 and an outlet pipe 35. Fluid flowing into and out of the air chamber 55 expands and contracts the air chamber 55. In this embodiment, a compressed gas is used as the fluid.

The inlet pipe 33 is connected with a compressed gas tank (not shown) mounted at the outside, such that the compressed gas is supplied to the air chamber 55. Additionally, a valve (not shown) may be further mounted to the inlet pipe 33 to adjust a supplied quantity of the compressed gas according to an inner pressure of the air chamber 55. A pressure control valve may be used as the valve.

The outlet pipe 35 supplies a path to discharge the compressed air inside the air chamber 55. A valve (not shown) may be further mounted to the outlet pipe 35 to adjust a supplied quantity of the compressed gas according to an inner pressure of the air chamber 55. A pressure control valve may be used as the valve.

The supply and discharge of the compressed gas may be performed by a controller (not shown). The controller may use a variable resistor for controlling an air pressure when adjusting the quantity of the compressed gas being supplied to the air chamber 55.

The inlet pipe 33 and the outlet pipe 35 may be connected to pass through the inside of the central shaft 30, as shown in FIG. 6.

Figure 8:
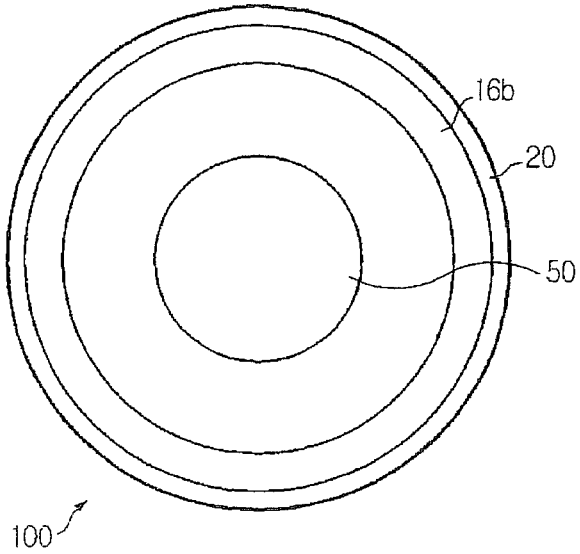
Fig. 8 PRIOR ART
FIG. 8 illustrates a bottom view of the pressure plate of FIG. 6.
Figure 9:
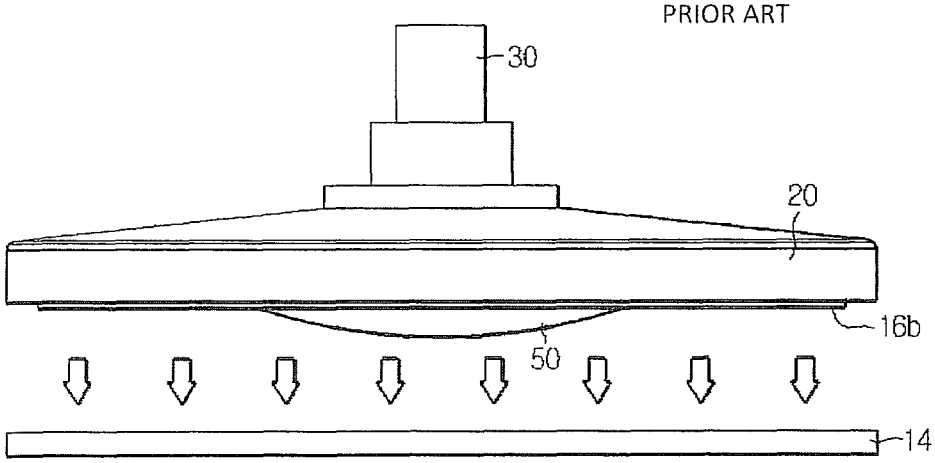
Fig. 9 PRIOR ART
FIG. 9 illustrates a front view showing the pressure applied by the pressure plate shown in FIG. 6 to the mounting block.

FIG. 8 illustrates a bottom view of the pressure plate shown in FIG. 6. FIG. 9 illustrates a front view showing the pressure applied by the pressure plate of FIG. 6 to the mounting block. Hereinafter, the operation of the pressure plate applying the pressure to the mounting block will be explained with reference to FIG. 8 and FIG. 9.

As shown in FIG. 8 and FIG. 9, the ring pad 16 mounted along the circumference of the lower surface of the main body 20 and the air bag 50 mounted in the center of the lower surface of the main body 20 each apply a pressure to the mounting block 14. More specifically, the air bag 50 is expanded as shown in FIG. 9 and thereby applies the pressure to the mounting block 14.

In this regard, the pressure applied to the mounting block 14 by the air bag 50 may be adjusted by controlling the quantity of the compressed gas being supplied to the air bag 50. Accordingly, a uniform pressure is applied to the entirety of the mounting block 14. As a consequence, the flatness of the polished wafer can be improved.

In FIG. 9, arrow marks denote the degree of the pressure applied by a lower surface of the pressure plate 100 to the mounting block 14.

According to the conventional method, the ring pad 16*b* is replaced according to change of polishing conditions so that a uniform pressure is applied to the mounting block 14 at all times. However, the present embodiment is distinctive from the conventional method in that a uniform pressure can be applied to the mounting block 14 by adjusting an expansion degree of the air bag 50 formed at the lower surface of the pressure plate 100.

Therefore, according to the embodiment of the present invention, cost and time for newly manufacturing the ring pad 16*b* according to the conditions can be economized. Furthermore, a downtime, during which the polisher can not be operated for replacement of the ring pad 16, can be considerably reduced.

According to another conventional method, a pressure by the cylinder (not shown) connected to the central shaft 30 may be adjusted instead of replacing the ring pad 16*b*. However, not only is it difficult to adjust the cylinder pressure, but the surface of the wafer may be damaged due to the non-uniform polishing rate caused by the varied pressure of the cylinder. On the contrary, the embodiment of the present invention is capable of adjusting the pressure using the air bag 50 while maintaining the pressure of the cylinder constantly. Thus, the pressure can be conveniently adjusted and the polishing rate can be kept constant.

Figure 10:
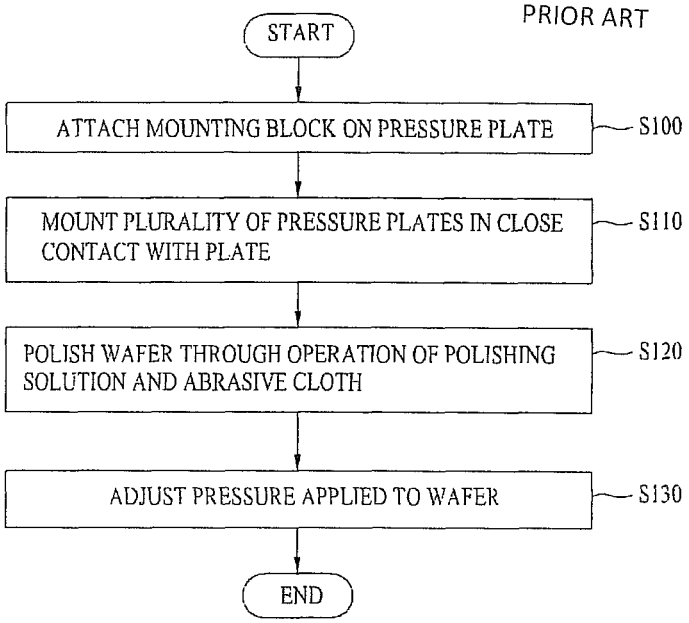
Fig. 10 PRIOR ART
FIG. 10 illustrates a flowchart of a method of polishing according to the embodiment of the present invention.

FIG. 10 is a flow chart explaining a method of polishing according to the embodiment of the present invention. Hereinafter, the polishing method will be explained with reference to FIG. 10.

The polishing method according to this embodiment refers to a method of polishing a wafer using the above-described polisher mounted with the pressure plate. First, the mounting block to which a wafer is bonded is attached to the pressure plate having the air bag and the ring pad mounted on one side thereof (S100). The shape and structure of the pressure plate are described hereinbefore.

Here, the pressure plate mounted with the mounting block is provided in plural numbers and is brought into close contact with a plate of the polisher (S110). The wafer bonded to the mounting block is postured to face the plate. In other words, a first face of the mounting block is attached with the pressure plate while a second face is bonded with the wafer to be polished.

A polishing solution is supplied to between the plate and the wafer. One surface of the wafer is polished by the operation of the polishing solution provided on the plate (S120).

A fluid is supplied to the air bag formed at one surface of the main body so that a uniform pressure is applied to the mounting block. More specifically, the air bag disposed in the center of one surface of the main body of the pressure plate applies a pressure to the center of the wafer. On the other hand, the ring pad disposed on the circumference of the one surface of the main body applies a pressure to a circumference of the wafer.

Adjustment of the pressure needs to be performed prior to the wafer polishing process. However, the pressure may be adjusted even during the polishing process if the pressures being applied to the center and to the circumference are different (S130). Such an adjustment of the pressure can be achieved through the inlet pipe and the outlet pipe connected to the main body of the pressure plate.

More specifically, the pressures applied by the ring pad and by the air bag are compared. If the pressure applied to the mounting block by the air bag is greater than the pressure applied to the mounting block by the ring pad, the fluid is discharged from the inside of the air bag through the outlet pipe connected to the main body of the pressure plate, such that a uniform pressure is applied to the entirety of the mounting block. If the pressure applied by the air bag is less than the pressure applied by the ring pad, the fluid is supplied into the air bag through the inlet pipe, such that a uniform pressure is applied to the entire part of the mounting block.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

Mode for the Invention

Various embodiments have been described in the best mode for carrying out the invention.

Industrial Applicability

As described above, a pressure plate of a polisher according to the embodiment of the present invention capable of improving flatness of a wafer.

The invention claimed is:

1. A method of polishing a wafer, comprising:

attaching a mounting block to which a wafer is bonded, to a pressure plate, a main body of which is mounted with an air bag on one surface thereof and a ring pad on a circumference of the one surface;

preparing and mounting a plurality of the pressure plates to which the mounting block is mounted, in close contact with a plate of a polisher; and supplying a polishing solution, to between the plate and the wafer, and polishing one surface of the wafer while adjusting a pressure applied to the mounting block by properly supplying the air into the air bag, wherein the main body of the pressure plate is provided with an inlet pipe and an outlet pipe so as to control supply and discharge of the air with respect to an inside of the air bag, and wherein a pressure applied by the ring pad to the mounting block and a pressure applied by the air bag to the mounting block are compared to each other, and the supply and discharge of the air with respect to the inside of the air bag are controlled so that a uniform pressure is applied throughout the mounting block.

2. The method according to claim 1, wherein the air hag is disposed in a center of the one surface of the main body of the pressure plate to apply a pressure to a center of the wafer, and the ring pad applies a pressure to a circumference of the wafer.

3. A polisher comprising:

a plate supplied with an abrasive cloth and a polishing solution;

at least one pressure plate, a main body of which is provided with an air bag on one surface thereof and a ring pad on a circumference of the one surface; and a mounting block, a first face of which is attached with the pressure plate and a second face of which is bonded with a wafer, wherein a depression having a predetermined depth and diameter is formed in a center of the one surface of the main body, wherein the air bag is mounted to cover the depression, thereby forming an air chamber, wherein a groove is formed around the depression, and a circumferential edge of the air bag is inserted in the groove and thereby fixed to the main body, and wherein a pressure applied by the ring pad to the mounting block and a pressure applied by the air bag to the mounting block are compared to each other, and the supply and discharge of the air with respect to the inside of the air bag are controlled so that a uniform pressure is applied throughout the mounting block.

4. The polisher according to claim 3, wherein the air bag is disposed in the center of the one surface of the main body of the pressure plate to apply a pressure to a center of the wafer, and the ring pad applies a pressure to a circumference of the wafer.

5. The polisher according to claim 3, further comprising an inlet pipe and an outlet pipe mounted to the main body of the pressure plate so as to control supply and discharge of the air with respect to an inside of the air bag according to an inner pressure of the air bag.

6. The method according to claim 1, wherein if the pressure applied to the mounting block by the air bag is greater than the pressure applied to the mounting block by the ring pad, the air is discharged from an inside of the air bag through the outlet pipe connected to the main body of the pressure plate.

7. The method according to claim 1, wherein if the pressure applied by the air bag is less than the pressure applied by the ring pad, the air is supplied into the air bag through the inlet pipe.

8. The polisher according to claim 3, wherein the aft bag is expanded and contracted in accordance with supply and discharge of the air with respect to an inside of the air bag.

9. The polisher according to claim 5, wherein the inlet pipe and the outlet pipe are mounted through an inside of a central shaft of the main body, the inlet pipe is provided with a valve to adjust supply of the compressed air according to an inner pressure of the air chamber, and the outlet pipe is provided with a valve to adjust discharge of the compressed air according to the inner pressure of the air chamber.

10. The polisher according to claim 3, wherein the air bag is in the form of a flat plate.

11. The polisher according to claim 3, wherein the depression and the groove are formed on a same surface of the main body, and the depression and the groove are formed in a same direction.

* * * * *